United States Patent [19]

Males

[11] 3,934,778

[45] Jan. 27, 1976

[54] STAPLE DRIVING DEVICE WITH IMPROVED STAPLE JAM CLEARING MECHANISM

[75] Inventor: Robert E. Males, Cranston, R.I.

[73] Assignee: Textron, Inc., Providence, R.I.

[22] Filed: Feb. 13, 1975

[21] Appl. No.: 549,747

[52] U.S. Cl. ..... 227/123
[51] Int. Cl.[2] ..... B25C 5/06
[58] Field of Search ..... 227/123

[56] References Cited

UNITED STATES PATENTS

| | | | |
|---|---|---|---|
| 3,041,614 | 7/1962 | D'Haem et al. | 227/123 |
| 3,272,417 | 9/1966 | Howard et al. | 227/123 |
| 3,273,777 | 9/1966 | Juilfs et al. | 227/123 |

FOREIGN PATENTS OR APPLICATIONS

| | | | |
|---|---|---|---|
| 182,704 | 7/1955 | Austria | 227/123 |

*Primary Examiner*—Granville Y. Custer, Jr.
*Attorney, Agent, or Firm*—Cushman, Darby & Cushman

[57] ABSTRACT

A staple driving device comprising a nosepiece assembly including a rigid structure having opposed flat side surfaces defining the sides of a drive track for guidingly engaging the legs of a leading staple during the driving movement thereof, a forwardly facing flat surface extending between the side surfaces for guidingly engaging the rear surface of a leading staple during the driving movement thereof, and longitudinally extending surfaces defining an opening of a staple-shaped configuration extending forwardly into communication with the drive track defining surfaces, and a rigid member mounted on said rigid structure forwardly of said staple-shaped opening for (1) translational movement in a direction parallel with the movement of the staple driving element between a locked operating position and a raised unlocked position and (2) pivotal movement between the raised unlocked position and a forwardly extending open access position, the rigid member having (1) staple stop surfaces facing rearwardly when the rigid member is in its locked operative position for engaging the forward surface of a leading staple after the feeding movement thereof, (2) staple guiding surfaces facing rearwardly when the rigid member is in its locked operative position for guidingly engaging the forward surface of a leading staple during the driving movement thereof, and (3) cam surfaces extending upwardly and forwardly from the upper end of staple stop surfaces when the rigid member is in its locked operative position operable (1) when the rigid member is pivoted from its unlocked position into its open access position to permit limited forward movement of a leading staple feed through the opening, and (2) when the rigid member is pivoted from its open access position to move a leading staple rearwardly into a position of alignment with the drive track.

9 Claims, 3 Drawing Figures

STAPLE DRIVING DEVICE WITH IMPROVED STAPLE JAM CLEARING MECHANISM

This invention relates to staple driving devices and more particularly to improvements in such devices for clearing the drive track of jammed staples.

Many different types of staple driving devices are known including portable pneumatically actuated devices, electrically actuated devices, hammer actuated devices, manual actuated devices, etc. A common characteristic of all these types of staple driving devices is the provision of a drive track, a staple driving element mounted in the drive track and a staple magazine assembly for receiving a supply of staples in stick formation and feeding successive leading staples in the stick laterally into the drive track to be driven outwardly thereof by the staple driving element. Several different types of magazine assemblies are known. These assemblies are usually designated by the manner in which they are loaded such as bottom loaders, front loaders, rear loaders and top loaders. Rear and top loaders are quite popular because of their simplicity of construction and operation. One disadvantage of each of these assemblies is that the drive track is normally defined by fixed structure and therefore, unless a movable drive track access part is provided, clearing of staples which become jammed in the drive track is difficult. There have been proposed many different drive track access providing arrangements in the prior art. A typical example is disclosed in U.S. Pat. No. 3,273,777. The arrangement as disclosed in this patent includes a nosepiece assembly providing a movable member pivotally mounted on the rigid structure thereof for movement between an operative position wherein the member defines the front wall of the drive track and an access position wherein the member extends forwardly so as to provide open access to the fixed surfaces defining the rear wall and sides of the drive track. In order to prevent forward movement of the staple stick under the bias of the pusher of the magazine assembly when the movable member is in its open access position, a fixed portion of the rigid structure of the nosepiece is disposed in a position to engage the leading surface of the crown of the leading staple, which surface constitutes the stop surface for the leading staple when the movable member is disposed in its operative position as well.

Basically there are two types of jams which must be cleared. One type is where the legs of the staple move rearwardly into the magazine as the crown is moved downwardly during the driving movement of the staple driving element either because the legs did not properly enter into the drive track from the magazine or they are somehow deflected rearwardly during the driving action. Jams of this type can be readily cleared when the aforesaid movable member is disposed in its open access position since the entire portion of the drive track where the jam is located is open. Another occurs as a result of a staple crown entering the drive track in a horizontally canted relation so that a part adjacent one leg extends into the drive track and another part adjacent the other leg is still supported by the magazine. As the staple driving element descends, the crown may be deformed into wedged engagement with the drive track with a portion thereof still within the magazine. Jams of this type cannot be readily cleared in the prior art arrangement due to the provision of the fixed stop surface previously described.

It is an object of the present invention to provide a staple driving device having improved staple jam clearing means which achieves all of the advantages of the prior art arrangements but overcomes the known disadvantages thereof. In accordance with the principles of the present invention this objective is obtained by mounting the movable member for (1) upward sliding movement from a locked operative position into a raised unlocked position and (2) pivotal movement between the raised unlocked position and a forwardly extending open access position. The first movement requires the access member to be moved in a direction opposed to the direction in which the jam occurred which has a tendency to loosen the jam. The surfaces for preventing forward pusher biased movement of the staple stick beyond the drive track are provided on the access member in the form of cam surfaces which relieve or widen the space adjacent the crown cut-off surfaces for the staple adjacent the leading staple as the second movement of the access member is effected. In this way a crown jam of the second type is readily cleared.

Another object of the present invention is the provision of a staple driving device having improved jam clearing means which is simple in construction, effective in operation and economical to manufacture.

These and other objects of the present invention will become more apparent during the course of the following detailed description and appended claims.

The invention may best be understood with reference to the accompanying drawings wherein an illustrative embodiment is shown.

Figure 1:
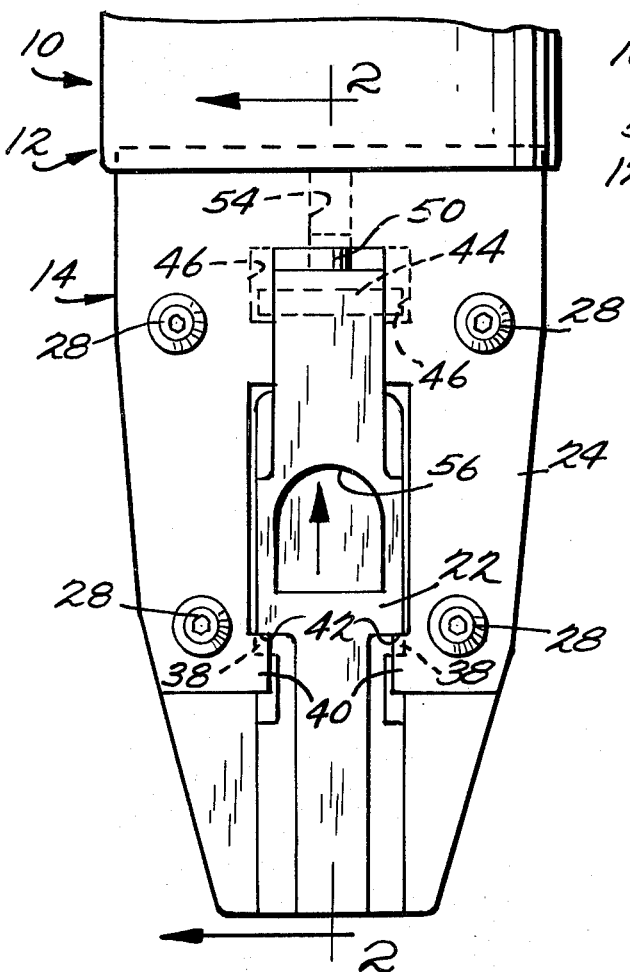
FIG. 1 is a fragmentary front elevational view of a staple driving device embodying the principles of the invention showing the parts in their normal operative position.

Referring now more particularly to the drawings, there is shown therein a staple driving device, generally indicated at 10. The device 10, as shown, is in the form of a conventional portable pneumatically-actuated tool, although devices of other well-known types are contemplated as well. For present purposes it is sufficient to note that the device comprises a housing, generally indicated at 12, which includes a nosepiece assembly 14 defining a staple drive track 16, a stapling driving element 18 slidably mounted within the drive track 16 for downward movement through a staple drive and for upward movement through a return stroke, and a staple magazine assembly 20 for receiving a supply of staples in stick formation and feeding successive leading staples laterally into the drive track 16 for movement outwardly thereof into a workpiece by the staple driving element 18 during the staple drive stroke thereof.

It will be understood that the staple driving element 18 may be moved through successive cycles including a drive stroke and a return stroke by any suitable means such as a pneumatic piston and cylinder arrangement conventionally employed in portable pneumatically actuated tools, or other known means. The magazine assembly may be of any known construction of the conventional rear or top loading type frequently employed in portable pneumatic tools.

The present invention is more particularly concerned with the construction of the nosepiece assembly and the capabilities thereof which enable an operator to gain open access to the drive track when a staple becomes jammed therein during operation for the purposes of clearing the drive track of such jammed staples. As shown, the nosepiece assembly 14 includes a movable rigid member 22 and a rigid structure made up of two stationary rigid members 24 and 26 detachably fixed together and to the magazine assembly and housing as by a series of bolts 28.

Member 26 is disposed inwardly of member 24 and is formed with two opposed side surfaces 30 which define the sides of the drive track 16 for guidingly engaging the outer surfaces of the legs of the leading staple during the driving movement thereof. Inner member 26 also includes a forwardly facing flat vertically extending surface 32 disposed between the side surfaces 30 which defines the rear face of the drive track 16 and longitudinally extending surfaces 34 which define an opening of staple shaped configuration which communicates forwardly with the drive track and through which a leading staple of the staple stick supported with the magazine assembly 20 is fed into the drive track.

In the embodiment shown, the staple driving element 18 is of T-shaped cross-sectional configuration for strength purposes, the stem of the T being oriented forwardly and the cross of the T being of a size to engage the crown of the staple. The forward portion of the drive track 16 extending downwardly from a position above the upper edge of the staple opening surfaces 34 is defined by surfaces 36 formed on the rearward face of the movable rigid member 22 which conform to the forward surfaces of the T-shaped staple driving element 18. The upper portion of the surfaces 36, which are disposed in opposing relation to the staple shaped opening, constitute staple stop surfaces for engaging the forward surface of a leading staple after it has been fed through the opening by the magazine assembly 20. These stop surfaces are disposed in a position spaced longitudinally from the opening surfaces 34 a distance equal to the thickness of the staple measured in the direction of extent of the stick so that when engaged by a leading staple it will be aligned within the drive track 16. The portion of the surfaces 36 extending below the staple stop surfaces guidingly engage the forward surface of a leading staple in the drive track 16 during its driving movement.

Figure 2:
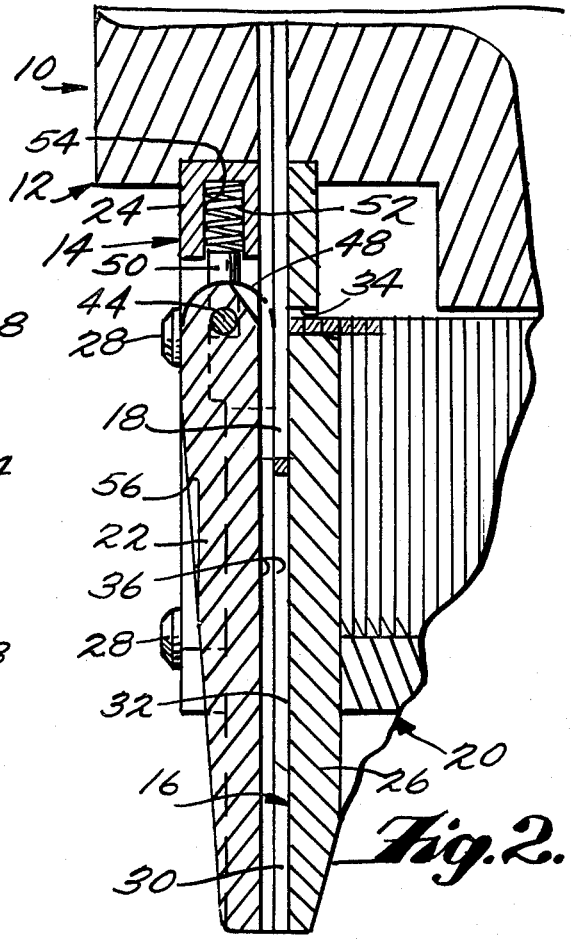
FIG. 2 is a fragmentary sectional view taken along the line 2—2 of FIG. 1.

The surfaces 36 of the movable member 22 are disposed and function in the manner indicated above when the movable member 22 is disposed in its normal operative position as shown in FIGS. 1 and 2. The movable member includes a pair of spaced forwardly facing flat locking surfaces 38 disposed parallel with the drive track surface 32 which engage cooperating rearwardly facing locking surfaces formed on a pair of opposed locking tabs 40 provided in the outer member 24. The cooperative engagement of the locking surfaces 38 with the locking surfaces of tabs 40 serves to lock the movable member 22 against forward movement out of its normal operative position. It will also be noted that movable member 22 includes downwardly facing surfaces 42 extending forwardly from the upper edges of the locking surfaces 38 which engage cooperating upwardly facing surfaces on the tabs 40 to prevent downward movement of the movable member beyond its normal operative position.

Figure 3:
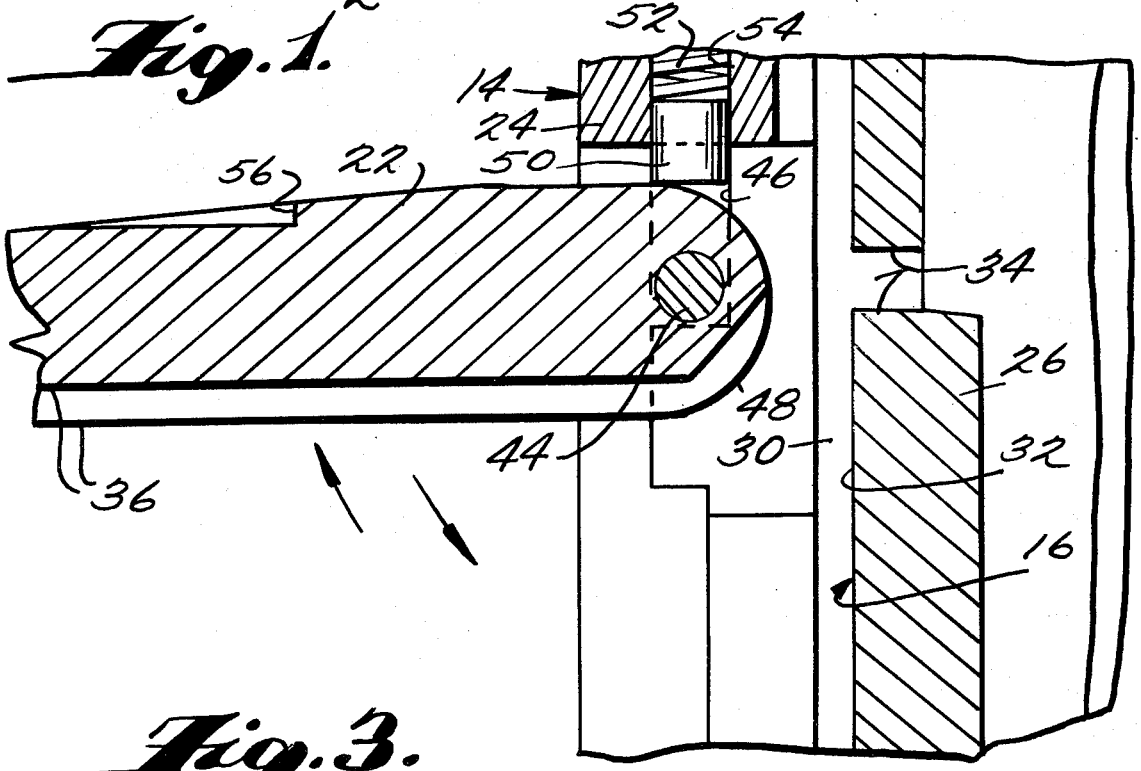
FIG. 3 is an enlarged fragmentary view similar to FIG. 2 showing the movable access member in its open access position.

Movable member 22 is mounted on the rigid structure defined by the inner and outer members 24 and 26 for (1) vertical translational movement between its normal locked operative position and a raised unlocked position and (2) pivotal movement between its raised unlocked position and a forwardly extending open access position, as shown in FIG. 3. This mounting is accomplished by any suitable means, a preferred embodiment shown, comprising a shaft 44 mounted within the upper portion of movable member 22 so that its ends protrude laterally from the member to define a pair of spaced pivot pins. Outer member 24 is formed with a pair of vertically extending grooves 46 which receive the pivot pin defining ends of the shaft 44.

Extending upwardly and forwardly from the drive track defining surfaces 36 on the movable member 22 are cam surfaces 48. As shown, these cam surfaces 48 are arcuate about an axis eccentric with respect to the axis of the shaft so that the horizontal distance from the forward edge of the surface 34 upon which the staple next to the leading staple rests varies progressively from a distance equal to the thickness of the crown, as aforesaid, when the movable member is disposed in its raised unlocked position to a predetermined greater relief distance when the movable member is disposed in its forwardly extending access position. The predetermined greater relief distance is preferably slightly greater than twice the thickness of a staple crown but of course may be greater or slightly less. Also, as shown, the cam surfaces 48 are provided initially on opposite sides of the member 22 laterally outwardly of the central portion which receives the stem of the T-shaped driver. As the surfaces extend forwardly beyond the stem receiving groove they merge into a single surface extending all the way across the member 22, which single surface is curved forwardly and downwardly to the front surface of the member. The curved forward extension of the cam surfaces 48 serve to engage the lower end of a button 50 which forms a part of a means for resiliently biasing the movable member downwardly. As shown, the resilient means further includes a coil spring 52 disposed within the inner end of a bore 54 formed in member 24, the button 50 being slidably disposed within the bore in engagement with the spring 52. The resilient means thus serves to bias the movement member toward its operative position and to yieldably maintain the same therein with the abutment surfaces 42 thereof in engagement with the tabs 40. To assist in moving the member 22 upwardly out of its operative position against the resilient biasing means and against any bias caused by a jam, a downwardly facing surface 56 is formed in the central forward portion of the member 22. The surface 56 is adapted to receive one end of an impacting tool, such as a screw driver or the like, (not shown) the opposite end of which can be impacted as by a hammer to move the member from its locked position into its raised unlocked position.

It can be seen that when a jam occurs and the access member 22 is moved upwardly from the locked operative position shown in FIGS. 1 and 2 into its raised unlocked position, locking surfaces 38 will move out of engagement with the tabs 40 permitting the member to be pivoted forwardly into the open access position shown in FIG. 3. The upward translational movement of the member in a direction opposed to the direction of the drive stroke of the staple driving element tends to relieve any wedging action that may have occurred as a result of the jam. With the member 22 in its open access position it will be appreciated that a staple jammed in the lower part of the drive track, as with a leg jam, may be readily cleared from the open drive track. After the staple has been cleared, cam surface 48 prevents the staple stick from being biased forwardly out of the magazine by the pusher of the magazine assembly. When the member 22 is pivoted from its open access position back toward its raised unlocked position, cam surfaces 48 will cam the staple stick rearwardly by engagement with the forward crown surface of the leading staple until the leading staple is properly positioned within the drive track. The operator then moves the member upwardly into its raised unlocked position against the bias of spring 52 so that it will move downwardly thereby (and with manual assistance if needed) into the locked operative position.

It is important to note that if the staple jammed into the drive track is a crown type jam, the aforesaid two access movements will likewise enable the operator to clear the jammed staple since the forward confinement thereof is relieved by the action of cam surfaces 48. Again, when this jammed staple is cleared, the cam surfaces 48 will provide the camming function previously noted.

It thus will be seen that the objects of this invention have been fully and effectively accomplished. It will be realized, however, that the foregoing preferred specific embodiment has been shown and described for the purpose of illustrating the functional and structural principles of this invention and is subject to change without departure from such principles. Therefore, this invention includes all modifications encompassed within the spirit and scope of the following claims.

What is claimed is:

1. A staple driving device comprising means defining a staple drive track, a staple driving element slidably mounted in said drive track for downward movement through a staple driving stroke and upward movement through a return stroke, said drive track defining means including a rigid structure having opposed flat side surfaces defining the sides of said drive track for guidingly engaging the legs of a leading staple during the driving movement thereof, a forwardly facing flat surface extending between said side surfaces for guidingly engaging the rear surface of a leading staple during the driving movement thereof, and longitudinally extending surfaces defining an opening of a staple-shaped configuration extending fowardly into communication with said drive track defining surfaces, staple magazine means for receiving a stick of staples and feeding successive leading staples forwardly into said drive track through said staple-shaped opening to be driven outwardly of said drive track into a workpiece by said staple driving element during the staple driving stroke thereof, said drive track defining means also including a rigid member mounted on said rigid structure forwardly of said staple-shaped opening for (1) translational movement in a direction parallel with the movement of said staple driving element between a locked operating position and a raised unlocked position and (2) pivotal movement between said raised unlocked position and a forwardly extending open access position, said rigid member having (1) staple stop surface means facing rearwardly when said rigid member is in said locked operative position for engaging the forward surface of a leading staple after the feeding movement thereof through said staple-shaped opening by said magazine means, (2) staple guiding surface means facing rearwardly when said rigid member is in said locked operative position for guidingly engaging the forward surface of a leading staple during the driving movement thereof by said staple driving element, and (3) cam surface means extending downwardly and forwardly from the upper end of said staple stop surface means when said rigid member is in said locked operative position operable (1) when said rigid member is pivoted from said unlocked position into said open access position to permit limited forward movement of a leading staple fed through said opening, and (2) when said rigid member is pivoted from said open access position to move a leading staple rearwardly into a position of alignment with said drive track.

2. A staple driving device as defined in claim 1 wherein said rigid member is mounted for said translational and pivotal movement by means including pivot pins extending from upper side edges of said rigid member, said rigid structure having grooves formed therein slidably and rotatably receiving said pivot pins.

3. A staple driving device as defined in claim 2 wherein said rigid structure includes a bore extending upwardly therein above said cam means, a button slidably mounted within said bore and extending downwardly therefrom into engagement with said cam surface and spring means within said bore resiliently urging said button downwardly.

4. A staple driving device as defined in claim 3 wherein said rigid member includes locking surface means facing forwardly in parallel relation with said drive track when said rigid member is disposed in said locked operative position and cooperating opposed locking surfaces on said rigid structure.

5. A staple driving device as defined in claim 4 wherein the central forward portion of said rigid member includes a downwardly facing surface for receiving a tool capable of being impacted to move said rigid member from said locked operative position into said raised unlocked position when a staple is jammed in said drive track.

6. A staple driving device as defined in claim 1 including spring means for resiliently urging said rigid member toward said locked operating position and cooperating abutment surfaces on said rigid member and said rigid structure interengageable when said rigid member is in said normal locked position to prevent movement therebeyond under the bias of said spring means.

7. A staple driving device as defined in claim 1 wherein said movable member is formed with a downwardly facing surface in its central forward portion for receiving an impact tool to effect the movement of said member from said operative locked position into said raised unlocked position when a staple is jammed in said drive track.

8. A staple driving device as defined in claim 1 wherein said rigid member includes locking surface means facing forwardly in parallel relation with said drive track when said rigid member is disposed in said locked operative position and cooperating opposed locking surfaces on said rigid structure.

9. A staple driving device as defined in claim 8 wherein the central forward portion of said rigid member includes a downwardly facing surface for receiving a tool capable of being impacted to move said rigid member from said locked operative position into said raised unlocked position when a staple is jammed in said drive track.

* * * * *